United States Patent [19]

Lutz

[11] Patent Number: 4,788,391

[45] Date of Patent: Nov. 29, 1988

[54] HYDRAULIC OR PNEUMATIC DRIVE FOR ACTUATING THE MOVABLE SWITCH CONTACT OF A MEDIUM AND/OR HIGH-VOLTAGE POWER SWITCH

[75] Inventor: Ferdinand Lutz, Heppenheim, Fed. Rep. of Germany

[73] Assignee: Asea Brown Boveri AG, Baden, Switzerland

[21] Appl. No.: 174,089

[22] Filed: Mar. 28, 1988

[30] Foreign Application Priority Data

Mar. 26, 1987 [DE] Fed. Rep. of Germany ..... 3709988

[51] Int. Cl.[4] ..... H01H 33/28

[52] U.S. Cl. ..... 200/148 F; 200/82 B

[58] Field of Search ..... 200/148 F, 148 R, 82 B

[56] References Cited

U.S. PATENT DOCUMENTS

| | | | |
|---|---|---|---|
| 4,251,701 | 2/1981 | Meyer | 200/82 B |
| 4,348,565 | 9/1982 | Yeckley et al. | 200/82 B |
| 4,581,510 | 4/1986 | Bischofberger et al. | 200/148 F |
| 4,730,092 | 3/1988 | Eggert et al. | 200/148 F |

FOREIGN PATENT DOCUMENTS

| | | |
|---|---|---|
| 1765415 | 7/1971 | Fed. Rep. of Germany . |
| 2361972 | 12/1982 | Fed. Rep. of Germany . |
| 3447132 | 7/1986 | Fed. Rep. of Germany . |

*Primary Examiner*—Robert S. Macon

*Attorney, Agent, or Firm*—Herbert L. Lerner; Laurence A. Greenberg

[57] ABSTRACT

A hydraulic or pneumatic drive for actuation of a movable switch contact of a medium and/or high-voltage power switch, especially an SF6-gas-insulated high-voltage power switch, includes a drive piston coupled to the movable switch contact. Fluid is delivered under pressure to the drive piston from a fluid reservoir configuration in order to perform one switching cycle having a given number of required switching operations. The fluid reservoir configuration has the given number of mutually separate independently acting storage chambers each having an energy content sufficient for a required switching operation.

15 Claims, 6 Drawing Sheets

10
11
16
13

15
12
41
38
19
17
39
14
37
18
36
20
20a
40
35
25
34
24
32
31
27
33
26
30
28
29
42
44
21
45
46
43
22
23

HYDRAULIC OR PNEUMATIC DRIVE FOR ACTUATING THE MOVABLE SWITCH CONTACT OF A MEDIUM AND/OR HIGH-VOLTAGE POWER SWITCH

The invention relates to a hydraulic or pneumatic drive for actuating the movable switch contact of a medium and/or high-voltage power switch, having a fluid reservoir from which fluid under pressure is deliverable to a drive piston coupled to the movable switch contact, at least for making and breaking contact.

The objective of drives of the above-mentioned type is to furnish the energy necessary for making and breaking contact in the switch, for converting this energy upon a switching operation into the mechanical motion necessary for separating or connecting the switch contacts, and optionally for furnishing the quantity of energy required for extinguishing an arc upon contact breaking.

In most cases, the energy stored in the energy reservoir of the power switch drive must suffice for a plurality of contact making and breaking operations, without allowing recharging of the energy reservoir in the meantime. During one such switching cycle, which includes a plurality of contact making and breaking operations in a specific prescribed order, the switch contact speed must remain within a predetermined range. In conventional switch drives at the present time, this is attained by ensuring that the drive force during the switching cycle remains constant in a first approximation, or only drops slightly. At the end of a switching cycle, the drive force furnished by the drive means has just dropped to the required minimum value. The energy still present in the energy reservoir at the end of the switching cycle cannot be further utilized, because in that case the drive force would drop below the required minimum value upon a further switching operation, and the switch could no longer fulfill its task reliably. In others words, in present conventional power switch drives, the drive energy stored in the energy reservoir is considerably greater than the energy actually required during the switching cycle, and this required overcapacity dictates the structural size and costs of present power switch drives.

It is accordingly an object of the invention to provide a hydraulic or pneumatic drive for actuating the movable switch contact of a medium and/or high-voltage power switch, which overcomes the hereinafore-mentioned disadvantages of the heretofore-known devices of this general type, which is less expensive than conventional drives, which is structurally smaller, and in which the energy stored and given up is optimally adapted to the required switching cycles With the foregoing and other objects in view there is provided, in accordance with the invention, a hydraulic or pneumatic drive for actuation of a movable switch contact of a medium and/or high-voltage power switch, comprising a drive piston coupled to the movable switch contact, a fluid reservoir configuration, means for delivering fluid under pressure from said fluid reservoir configuration to said drive piston in order to perform one switching cycle having a given number of required switching operations (for example, a contact making, breaking, and making cycle), said fluid reservoir configuration having said given number of mutually separate independently acting storage chambers each having an energy content sufficient for a required switching operation.

In accordance with the invention, the drive energy is divided into a plurality of "energy servings", so that the energy required for a plurality of switching operations derives from a plurality of storage chambers or, in other words, energy reservoirs. Thus one storage chamber is emptied per switching operation, or in other words per contact making or breaking, which enables a considerably better adaptation of the force curve which is furnished to the force requirement which is needed, and which finally also enables better adaptation of the energy content of the total drive reservoir to the energy requirement. This reduces the volume of the total energy reservoir, especially because once the complete switching cycle has elapsed, virtually all the energy present in the fluid reservoir apparatus can be utilized. A useless residual energy of the magnitude that is still present in the prior art drives after a switching cycle is no longer contained in the fluid reservoir apparatus of the drive according to the invention.

A further advantage of the drive according to the invention is as follows:

As mentioned above, the drive force in the conventional switch drives is approximately constant to a first approximation, so that in each case the drive force furnished by the drives at the end of the switching cycle is still sufficient for a required contact breaking operation. However, modern power switches, in particular pneumatic piston switches or automatic pneumatic power switches do not at all require a constant drive force but rather a force that drops steadily. If a fluid reservoir is only dimensioned in terms of the energy required for one switching operation, that is, a contact making operation or a contact breaking operation, then the almost automatic result is a force curve corresponding to the requirements. The energy stored in the individual storage chambers for a single switching operation thus approximately corresponds to the energy required for the switch for this switching operation. The energy required for one switching cycle and hence for a plurality of switching operations is thus significantly less than the total energy of the energy reservoirs typical in present-day power switch drives.

It is known from German Published, Non-Prosecuted Application DE-OS 26 41 885 to provide a separate reservoir for each contact breaking or contact making operation. However, this relates to a mechanical spring drive, in which one contact making spring and two contact breaking springs are provided for one off/on/-off switching cycle, for instance. The device is constructed in such a way that during one switching operation each contact breaking spring also gives its energy back to the contact making spring for charging thereof. Thus, unlike the drive according to the invention, there is no actual splitup of the energies for a contact making operation and a contact breaking operation into two separate reservoirs. Instead, all the energy required for contact making and contact breaking is stored in a single reservoir, which is a contact breaking spring. In general, such mechanical drives are not optimally suitable, and furthermore because of the necessity for charging the contact making spring when a contact breaking operation is performed, an oversized dimensioning of at least the contact breaking spring is very likely necessary, and additionally the charging of a spring reservoir is very complicated. If a plurality of off/on/off switching cycles are to be performed, as required by regulations in the United States, for example, then the required energy reservoir becomes too complex, too expensive and too large a structure.

Furthermore, it is not possible to use electronic controls such as can be used in hydraulic or pneumatic drives for actuating valves.

Advantageously, each storage chamber can be constructed either as a diaphragm reservoir or a piston spring reservoir, or as a diaphragm spring reservoir.

A feature which makes the drive particularly inexpensive is that of accommodating the storage chambers in a single housing block.

For further simplification and for further cost reduction, the piston/cylinder configuration for actuating the movable switch contact and a low-pressure container for receiving the fluid used upon each switching operation can also be accommodated inside the housing block, in addition to the storage chambers.

The housing block, which is preferably a cast block, can advantageously have a lower and an upper housing part, the lower part having cavities originating at the surface oriented toward the upper part, the cavities forming at least partial chambers of the storage chambers, the low-pressure collecting chamber and the cylinder chamber of the piston/cylinder configuration. The housing block may be subdivided further, which may be advantageous in some circumstances.

The pressure fluid chamber of each storage chamber forming a diaphragm reservoir may be formed by the cavities in the lower part of the housing and the gas chamber may be formed by recesses provided in the upper part of the housing, with a diaphragm being fastened between the cavities and the recesses, at the parting plane between the lower and the upper housing parts.

Monitoring as to whether the individual reservoirs are charged or not takes place for instance as follows: The recesses for holding the reservoir gas for the diaphragm reservoirs are made deep enough that between the adjacent outside surface of the upper housing part and the bottom surface of the recesses, one wall region remains in each case, which is thin enough to deform elastically in a measurable manner upon charging with pressure fluid and resultant compressing of the reservoir gas. In this case the invention accordingly makes use of the fact that upon charging individual energy reservoirs, certain wall portions of the housing block with thicknesses dimensioned accordingly, deform as a result of the internal pressure This can, for example, be ascertained by using strain gauges This principle of measurement can be used in the same manner if the reservoirs are piston spring reservoirs or diaphragm spring reservoirs.

A further advantage of the invention is that it is possible for control valves, a fluid pump and a drive motor for the fluid pump to be additionally integrated into or flanged onto the housing block.

Other features which are considered as characteristic for the invention are set forth in the appended claims.

Although the invention is illustrated and described herein as embodied in a hydraulic or pneumatic drive for actuating the movable switch contact of a medium and/or high-voltage power switch, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
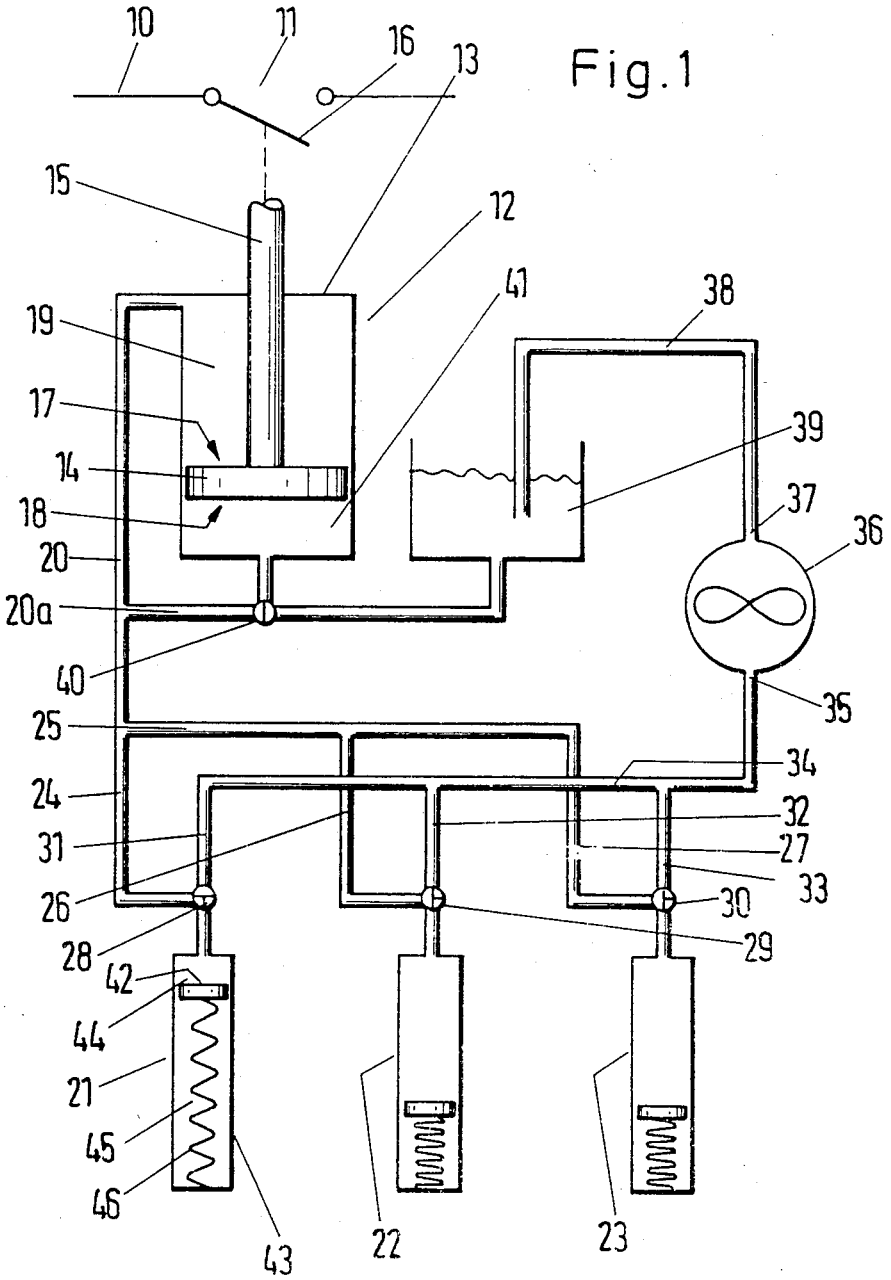
FIG. 1 is a diagrammatic and schematic circuit configuration of a first embodiment of a drive according to the invention.
Figure 4:
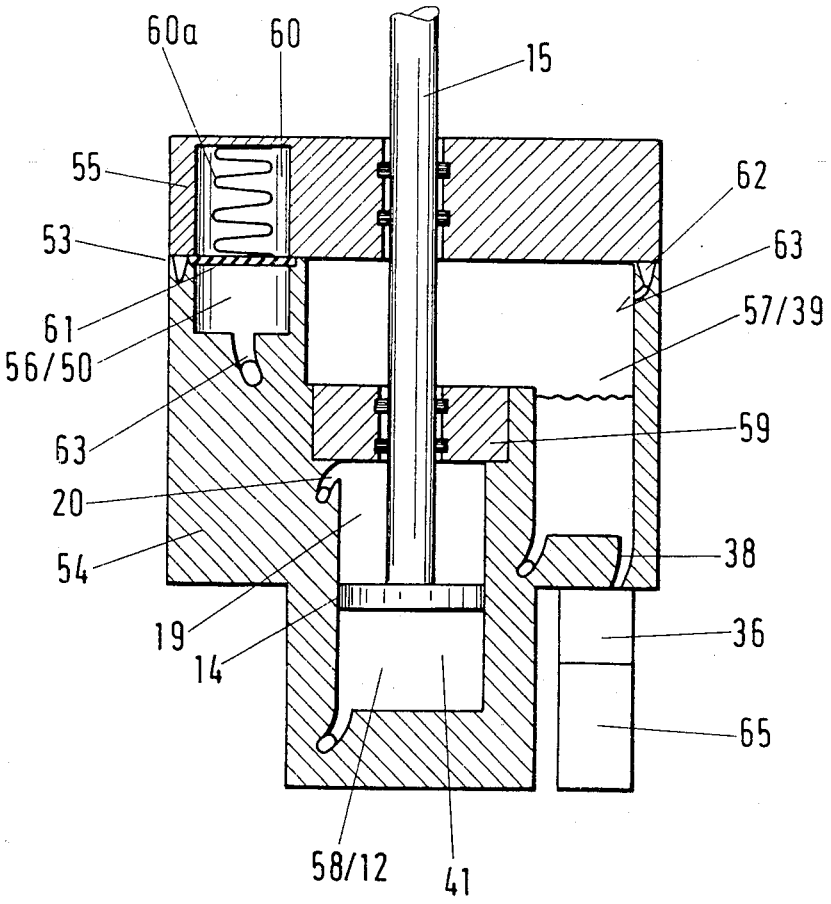
FIG. 4 is a diagrammatic, cross-sectional view of a drive according to the invention.
Figure 6:
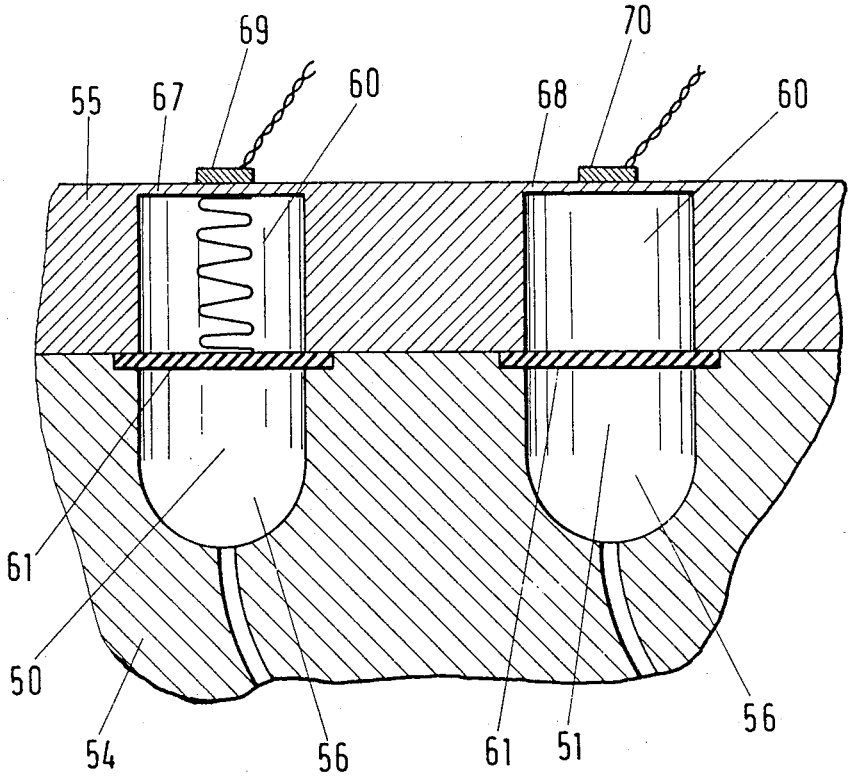
Figure 7:
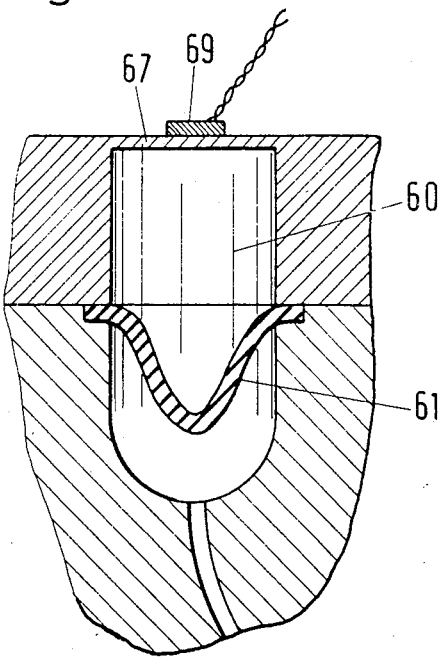
Figure 8:
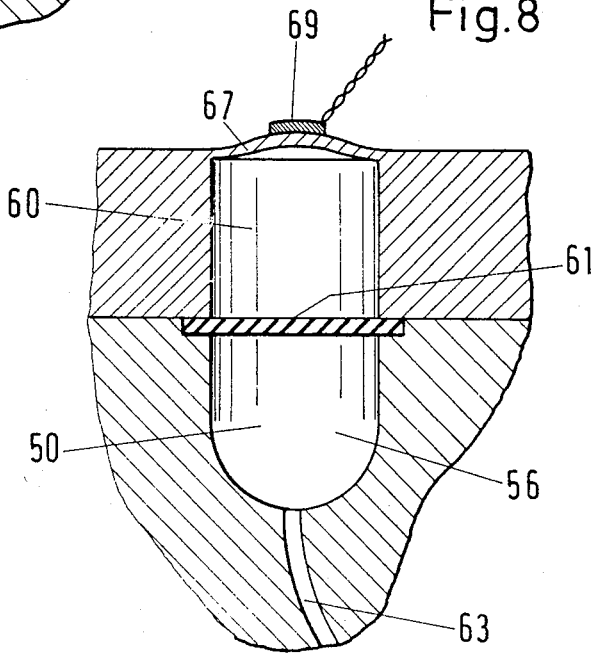

FIG. 6 is an enlarged, fragmentary cross-sectional view of the drive according to FIG. 4; and FIGS. 7 and 8 are fragmentary cross-sectional views similar to FIG. 6, in two different switch positions Referring now to the figures of the drawings in detail and first, particularly, to FIG. 1 thereof, there is seen an electric high-voltage power switch 11, which is schematically illustrated by a switch symbol and is located in a cable 10. The switch 11 is driven by a piston/cylinder configuration 12, including a piston 14 being located inside a cylinder 13 and having a piston rod 15 coupled to a movable switch contact 16 of the switch 11 The piston 14 is a differential piston, in which a piston surface area 17 above the piston is smaller than a piston surface area 18 of a chamber 41 below the piston, because of the adJoining piston rod 15.

A chamber 19 above the piston communicates with a first energy reservoir 21, a second energy reservoir 22 and a third energy reservoir 23 through a connecting line 20. The line 20 branches into a plurality of line segments 24, 25, 26 and 27, each of which communicates with the energy reservoirs 21–23 through respective valves 28, 29 and 30.

Branch lines 31, 32 and 33 adjoin the valves 28–30 and discharge into a pressure line 34, which is connected to the outlet 35 of a fluid pump 36. The inlet 37 of the pump 36 communicates through a return line 38 with a low-pressure container 39, which in turn communicates through a valve 40 with the chamber 41 below the piston 14 and with a line segment 20*a*.

The three energy reservoirs 21, 22 and 23 are of the kind known as spring energy reservoirs, in which a piston 42 is disposed in a cylinder chamber 43. Fluid is disposed on top of the piston 42 in a chamber 44, and a spring 46 which serves as an energy storage spring and sends fluid from the chamber 44 to the piston/cylinder configuration 12, is accommodated in an opposite chamber 45.

The switch or switchgear 11 is shown in an off position. When the piston 14 is seated at the upper end of the piston/cylinder configuration, the switch is in an on position. The on position is reached by supplying pressure fluid to the two chambers 19 and 21 above and below the piston 14 through the line 24. Due to the shape of the piston in the form of a differential piston, the supply of fluid through the line 24 causes the piston to be located in the on position. In order to break the contact, the valve 40 is merely reversed so that the chamber 41 is abruptly made to communicate with the low-pressure chamber 39. As a result, the pressure fluid flow from the chamber 44 through the lines 24 and 20 into the chamber 19, is heavier and presses the piston 14 into the contact breaking position. If the switch is to be turned back on, the valve 29 for the reservoir 22 is reversed, so that pressure fluid is applied to the chamber 41 through the partial line 26, 25, 20 and 20*a* and the valve 40, thus returning the differential piston to the on position. In order to permit a final contact breaking operation, the pressure chamber of the energy reservoir 23 is connected through the valve 30 and the lines 27, 25 and 20 with the chamber above the piston, and in order to initiate the contact breaking operation the valve 40 is reversed once again, so that the chamber 41 below the piston 14 communicates with the low-pressure container. The switching cycle of off/on/off (O-C-O) is concluded, and the pressure chambers 44 of the three energy reservoirs 21–23 must be placed under pressure once again to put the switch back into operation, or in other words to prepare to switch the switchgear 11 back on.

Figure 3:
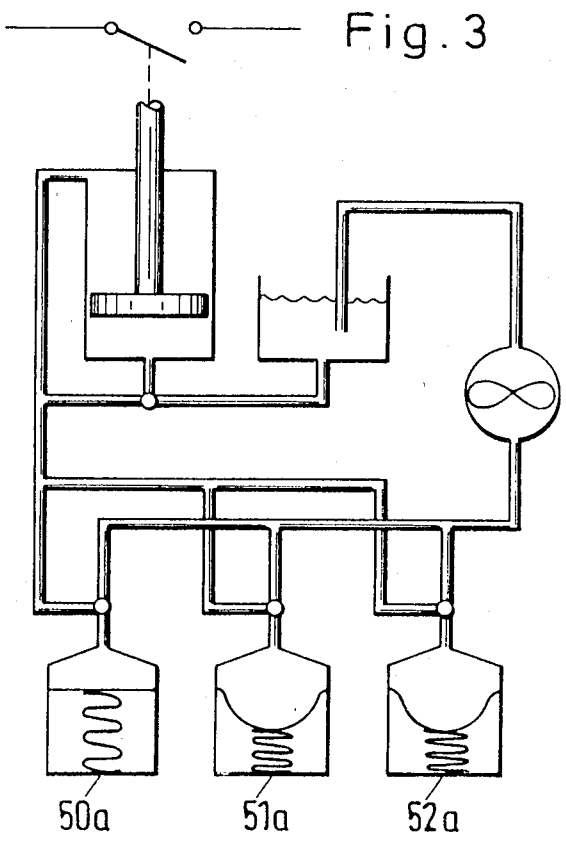
FIG. 3 is another view similar to FIGS. 1 and 2, of a circuit configuration of a third embodiment.
Figure 2:
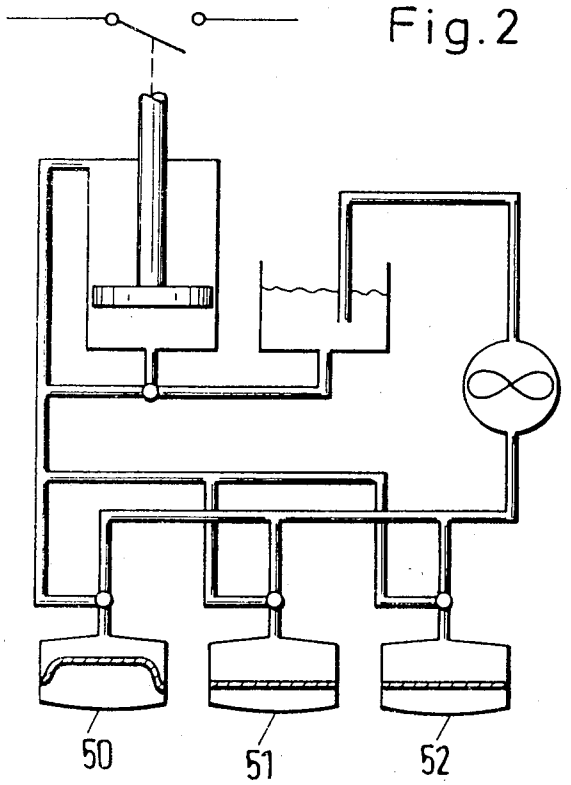
FIG. 2 is a view similar to FIG. 1 of a circuit configuration of a second embodiment.

The embodiment of FIG. 2 is practically identical to that of FIG. 1. However, in FIG. 2 the energy reservoirs 21–23 are replaced by gas diaphragm reservoirs 50, 51 and 52. In the embodiment of FIG. 3, unlike the embodiments of FIGS. 1 and 2, the energy reservoirs 21–23 are replaced by diaphragm spring reservoirs 50*a*, 51*a*, and 52*a*.

In the construction of the reservoir as a piston spring reservoir or as a diaphragm spring reservoir, the spring may, for example, be a helical spring or a plate spring.

The construction of the energy reservoirs as gas diaphragm reservoirs or as diaphragm spring reservoirs has the following substantial advantage which will be explained by reference to FIG. 4.

The entire unit shown in FIGS. 1, 2 and 3 as a hydraulic or pneumatic circuit, which will be referred to in short as a fluid circuit, is introduced into a drive housing block 53. The drive housing block 53 substantially includes a lower housing part 54 and a lid-like upper housing part 55. A plurality of cavities are provided in the lower housing part. One cavity 56 is part of a diaphragm reservoir, such as a diaphragm reservoir 50. A further cavity 57 is a low-pressure container 39, and still another cavity 58 serves as a piston/cylinder configuration 12, which includes the chamber 41 below the piston, the piston 14 itself, and the chamber 19 above the piston, which is closed off with a cover plate 59 and is perforated by the piston rod 15 of the piston 14. The upper housing part 55, through which the piston rod 15 also passes, has recesses 60 adapted to the number of cavities 56. The recesses 60 along with the respective cavities 56 each form one diaphragm reservoir 50, 51, and 52. One diaphragm 61 is provided in the region between each recess 60 and the cavity 56 of the various energy reservoirs 50, 51 and 52. In the case of a diaphragm spring reservoir, a spring 60*a* is disposed in the recess 60. All of the cavities 56 and 57 are surrounded by a groove 62, which communicates through bores 63 with the cavity 57, thereby providing optimal sealing against leakage.

Figure 5:
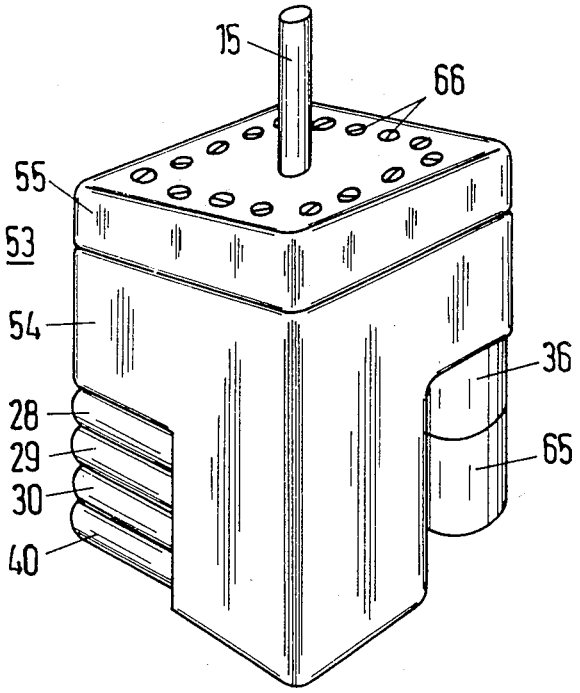
FIG. 5 is a perspective view of the drive of FIG. 4.

A pump 36 having an attached pump motor 65 is flanged onto the lower housing part 54. Valves are similarly flanged onto the lower housing part 54, but they are not visible in the sectional view of FIG. 4. Inside the lower housing part 54, conduits acting as fluid lines connect the storage chambers or cavities 56, the relief chamber or cavity 57, the pump 36, the valves and the partial chamber 19 or cavity 58 of the piston/-cylinder configuration in the manner shown in FIGS. 1–3. These conduits are shoWn in FIG. 4 as segments 63, 20 or 38, for example. The valves 28, 29 and 20 or 40 are seen protruding laterally in FIG. 5. The upper housing part 55 is connected with the lower housing part 54 by means of screw connections 66.

FIG. 6 is a sectional view through the lower housing part 54 and the upper housing part 55, wherein two adjacent cavities 56 along with two corresponding recesses 60 in the block of the upper housing part form two reservoirs, such as the reservoir 50 and the reservoir 51. As FIG. 4 shows, one diaphragm 61 is provided in each case between the lower housing part 54 and the upper housing part 55, thereby separating the two chambers 56 and 60 from one another. The chamber 60 is the gas side or spring side of the diaphragm reservoir, while the chamber 56 is the oil or fluid side. The cavities or the recesses 60 in the upper housing part 55 are dimensioned in such a way that only a comparatively thin wall region 67 or 68 remains, facing the outer surface of the upper part. A respective strain gauge or strain gauge device 69, 70 is provided on the outer surface of the upper part 55, with which the deformation of the wall region 67, 68 can be measured. This feature is shown in FIGS. 7 and 8.

FIG. 8 shows the reservoir 50 in the charged state. The cavity or fluid side 56 is filled with fluid up to the required pressure, which is typically a few hundred bar. As a result, the diaphragm 61 is nearly flat, and the gas in the chamber 60 is at the same high pressure as the pressure fluid in the chamber 50. As a result, as shown in exaggerated fashion in FIG. 8, the wall region 67 is caused to bulge outward, which can be detected by the strain gauge 69. If fluid is withdrawn from the chamber 56 or from the reservoir 50, which is accomplished through a line 63, then the diaphragm 61 is deformed downward into the cavity 56 by the pressure of the gas in the chamber 60, which is shown in FIG. 7, and this reduces the degree of outward bulging in the wall region 67, which can again be detected by the strain gauge 69. The shape of the recess in the upper housing part is dictated by the necessity of providing a sufficiently large wall region 67 with the required wall thinness.

The foregoing is a description corresponding in substance to German Application No. P 37 09 988 4, dated Mar. 26, 1987, the International priority of which is being claimed for the instant application, and which is hereby made part of this application. Any material discrepancies between the foregoing specification and the aforementioned corresponding German application are to be resolved in favor of the latter.

I claim:

1. Hydraulic or pneumatic drive for actuation of a movable switch contact of a medium and/or high-voltage power switch, comprising a drive piston coupled to the movable switch contact, a fluid reservoir configuration, means for delivering fluid under pressure from said fluid reservoir configuration to said drive piston in order to perform one switching cycle having a given number of required switching operations, said fluid reservoir configuration having said given number of mutually separate independently acting storage chambers each having an energy content sufficient for a required switching operation.

2. Drive according to claim 1, wherein the power switch is an SF6-gas-insulated high-voltage power switch

3. Drive according to claim 1, wherein each storage chamber is in the form of a gas diaphragm reservoir.

4. Drive according to claim 1, wherein each storage chamber is in the form of a spring diaphragm reservoir.

5. Drive according to claim 1, wherein each storage chamber is in the form of a spring reservoir.

6. Drive according to claim 1, including a housing block in which all of said storage chambers are disposed.

7. Drive according to claim 6, including a cylinder chamber forming a piston/cylinder configuration along with said drive piston for actuating the movable switch contact, said piston/cylinder configuration being disposed in said housing block along with said storage chambers.

8. Drive according to claim 7, including a low-pressure chamber disposed in said housing block for receiving fluid used upon each switching operation.

9. Drive according to claim 8, wherein said housing block has a lower housing part and an upper housing part, said lower housing part having a surface facing toward said upper housing part with cavities protruding therefrom, said cavities forming at least part of said storage chambers as well as said low-pressure chamber and said cylinder chamber of said piston/cylinder configuration.

10. Drive according to claim 3, including a housing block in which all of said storage chambers are disposed, said housing block having a lower housing part and an upper housing part divided along a parting plane, said lower housing part having a surface facing toward said upper housing part with cavities protruding therefrom, said cavities each forming a pressure fluid space of one of said gas diaphragm reservoirs, said upper housing part having recesses in the form of gas chambers formed therein, and diaphragms being fastened between said chambers and said recesses along said parting plane.

11. Drive according to claim 10, wherein said upper housing part has an outer surface facing away from said lower housing part and said upper housing part has inner surfaces defining bottoms of said recesses, said inner surfaces being spaced from said outer surface defining wall regions therebetween deforming elastically in a measurable manner upon charging with pressure fluid and resultant compression of reservoir gas in said recesses.

12. Drive according to claim 11, including means for utilizing said elastic deformation of said wall regions for measuring charging status of said storage chambers.

13. Drive according to claim 12, wherein said elastic deformation utilizing means are in the form of strain gauges disposed on said outer surface at said wall regions for measuring said deformation of said wall regions.

14. Drive according to claim 6, including control valves, a fluid pump and a drive motor for said fluid pump being integrated into said housing block.

15. Drive according to claim 1, including valves connected to said storage chambers being switchable for contact breaking and contact making operations, and a control unit having means for measuring charging status of said storage chambers, means for automatically recharging relieved storage chambers, and means for regulating control of said valves in contact breaking and contact making operations, taking into account the charging status of said storage chambers.

* * * * *